US005277243A

United States Patent [19]

Fukase et al.

[11] Patent Number: 5,277,243

[45] Date of Patent: * Jan. 11, 1994

[54] STRIP CASTING

[75] Inventors: Hisahiko Fukase, Wollongong, Australia; Heiji Kato, Yokosuka, Japan; Akihiro Nomura, North Wollongong, Australia

[73] Assignees: Ishikawajima-Harima Heavy Industries Company Limited, Tokyo, Japan; John Lysaght (Australia) Limited, Sydney, Australia

[ * ] Notice: The portion of the term of this patent subsequent to Feb. 9, 2010 has been disclaimed.

[21] Appl. No.: 941,276

[22] Filed: Sep. 4, 1992

Related U.S. Application Data

[63] Continuation of Ser. No. 679,664, Apr. 4, 1991, Pat. No. 5,184,668.

[30] Foreign Application Priority Data

Apr. 4, 1990 [AU] Australia ..... PJ9458

[51] Int. Cl.[5] ..... B22D 11/06; B22D 27/04

[52] U.S. Cl. ..... 164/428; 164/121; 164/338.1; 222/593

[58] Field of Search ..... 164/428, 480, 437, 121; 222/593

[56] References Cited

FOREIGN PATENT DOCUMENTS

| | | | |
|---|---|---|---|
| 269803 | 7/1989 | German Democratic Rep. | 222/593 |
| 60-145253 | 7/1985 | Japan | 164/480 |
| 61-176447 | 8/1986 | Japan | 164/480 |
| 63-40651 | 2/1988 | Japan | 164/437 |

*Primary Examiner*—Kuang Y. Lin

*Attorney, Agent, or Firm*—Nikaido, Marmelstein, Murray & Oram

[57] ABSTRACT

Apparatus for casting metal strip in which molten metal is introduced between a pair of parallel casting rollers (16) via a tundish (18) and metal delivery nozzle (19). Casting rollers (16) are cooled so that shells solidify on the moving roller surfaces and are brought together at the nip between them to produce a solidified strip product (20) at the roller outlet. The tundish (18), delivery nozzle (19) and a pair of side closure plates (56) to confine the pool of metal on the casting rollers are separately preheated to working temperature and then rapidly brought into an operative assembly and casting is started before detrimental uneven or localized cooling of the preheated components can develop. To this end the casting rollers are mounted on a carriage (13) movable between a first station (14) at which the preheated components are fitted and a second station (15) at which casting is carried out.

15 Claims, 7 Drawing Sheets

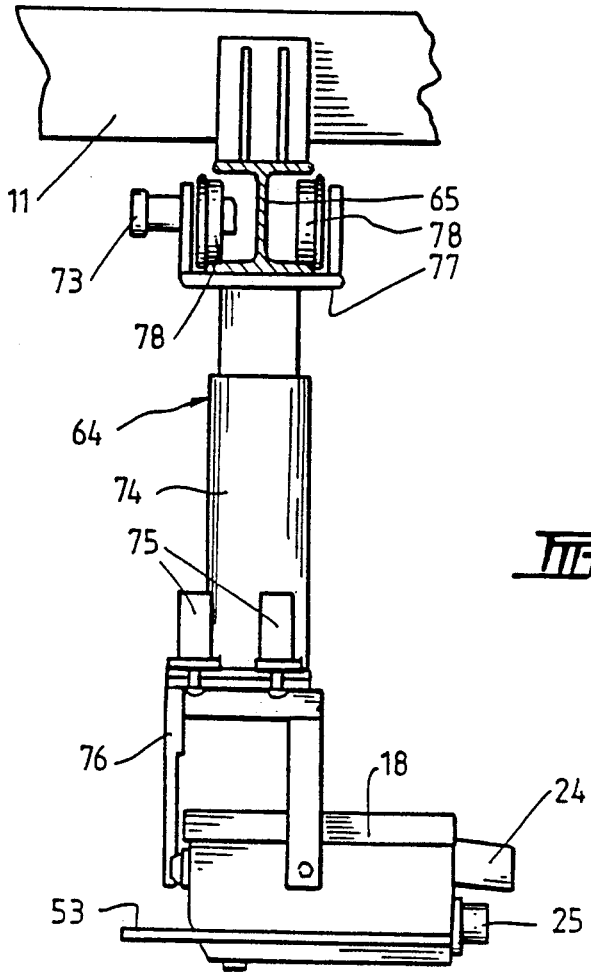
FIG. 4.
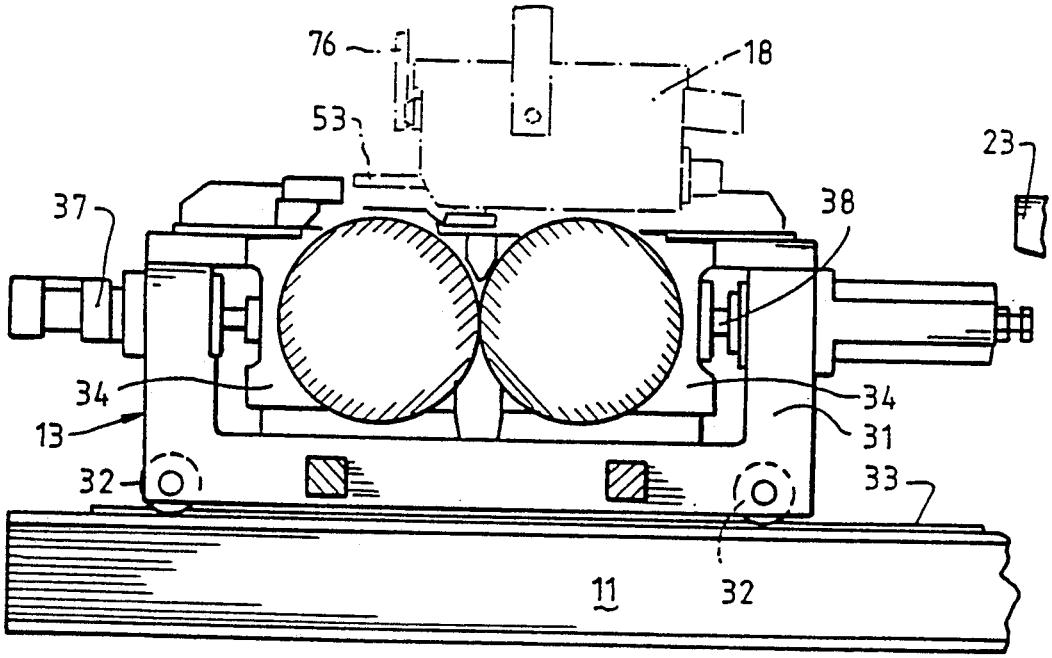

STRIP CASTING

This application is a continuation of application Ser. No. 07/679,664, filed Apr. 4, 1991, now U.S. Pat. No. 5,184,668.

TECHNICAL FIELD

This invention relates to the casting of metal strip. It has particular but not exclusive application to the casting of ferrous metal strip.

Twin roll casting has been applied with some success to the casting of some non-ferrous metals, for example aluminium, which solidify rapidly on cooling. However, endeavours to apply this technique to the casting of ferrous metals have been unsuccessful. The much slower rate of solidification of ferrous metals has generally led to problems at the commencement of a casting run in that it has not been possible to produce even cooling and solidification to allow continuous casting to proceed satisfactorily. We have now shown that this problem can be overcome by using a twin roll caster with certain components which are demountable and which can be separately preheated and then rapidly brought into an operative assembly and casting started before detrimental uneven or localized cooling of the preheated components can develop.

Although the invention is able to overcome the particularly severe start up problems encountered when casting ferrous metals, it is not limited to that particular application and it may also be applied to the casting of non-ferrous metals such as aluminium.

DISCLOSURE OF THE INVENTION

According to one aspect of the invention there is provided a method of casting metal strip of the kind in which molten metal is introduced between a pair of parallel casting rollers via a tundish and a metal delivery nozzle, wherein at the commencement of a casting operation the metal delivery nozzle and the tundish are preheated at preheating locations spaced from the rollers, the preheated delivery nozzle and tundish are moved into positions above the rollers, and molten metal is poured into the tundish to flow through the delivery nozzle to the rollers within a time interval no more than three minutes from the first of the movements of the delivery nozzle and the tundish from their preheating locations.

Preferably, the delivery nozzle and the tundish are preheated to at least 1000° C. Typically, they may be heated to about 1200°-1300° C.

Preferably, the method comprises the further step of applying preheated side closure plates to the ends of the rollers to form end closures of a reservoir for molten metal in the nip between the casting rollers after the assembly of the distribution nozzle and tundish with the casting rollers and before the pouring of the molten metal.

Preferably further, said time interval is no more than two minutes. It may be of the order of one and a half minutes.

According to a second aspect, the invention further provides a method of casting metal strip of the kind in which molten metal is poured between a pair of parallel casting rollers via a tundish and a metal distribution nozzle wherein, at the commencement of a casting operation, the metal delivery nozzle and the tundish are preheated at locations spaced from the rollers, the preheated delivery nozzle and tundish are moved into an assembly with the casting rollers so as to be positioned above the nip between the rollers and the assembly of the rollers, delivery nozzle and tundish is then moved to a casting station where molten metal is poured into the tundish to flow via the distribution nozzle to the nip between the casting rollers.

Preferably, this further method also comprises the step of applying preheated side closure plates to the ends of the rollers to form end closures of a reservoir for molten metal in the nip between the casting rollers.

The invention further provides apparatus for casting metal strip comprising:

- a casting roller carriage movable between first and second stations;
- a pair of generally horizontal casting rollers mounted on the roller carriage in parallel to form a nip between them;
- a metal delivery nozzle mountable on the roller carriage for delivery of molten metal into the nip between the casting rollers;
- a tundish mountable on the roller carriage for supply of molten metal to the delivery nozzle;
- means to preheat the delivery nozzle and the tundish;
- transfer means to transfer the preheated delivery nozzle and tundish from the preheating means to said first station for mounting onto the roller carriage when at the first station;
- carriage drive means operable to drive the roller carriage and with it the preheated delivery nozzle and tundish from the first station to the second station; and
- metal pouring means operable at said second station to pour molten metal into the tundish.

Preferably, the apparatus further comprises:

- a pair of demountable side closure plates to engage the casting rollers one at each end of the nip to form side closures of a reservoir for molten metal to be formed in use of the apparatus above the nip;
- side plate preheating means; and
- side plate applicator means operable to move the preheated side plates from the side plate preheating means into operative engagement with the casting rollers when the roller carriage is at the second station.

Preferably further, the side plate preheating means comprises a pair of side plate preheaters disposed to opposite sides of the second roller carriage station.

The side plate applicator means may comprise a pair of pressure fluid cylinder units operative to move the side plates toward one another from the locations of the side plate preheaters and to bias the side plates against the rollers under pressure of fluid in said cylinder units.

BRIEF DESCRIPTION OF THE DRAWINGS

In order that the invention may be more fully explained, one particular form of apparatus and its operation will now be described in some detail with reference to the accompanying drawings in which:

FIG. 4 is a partly sectioned elevation of a part of the caster which particularly illustrates a tundish lifting apparatus incorporated in the caster;

BEST MODE OF CARRYING OUT THE INVENTION

Figure 1:
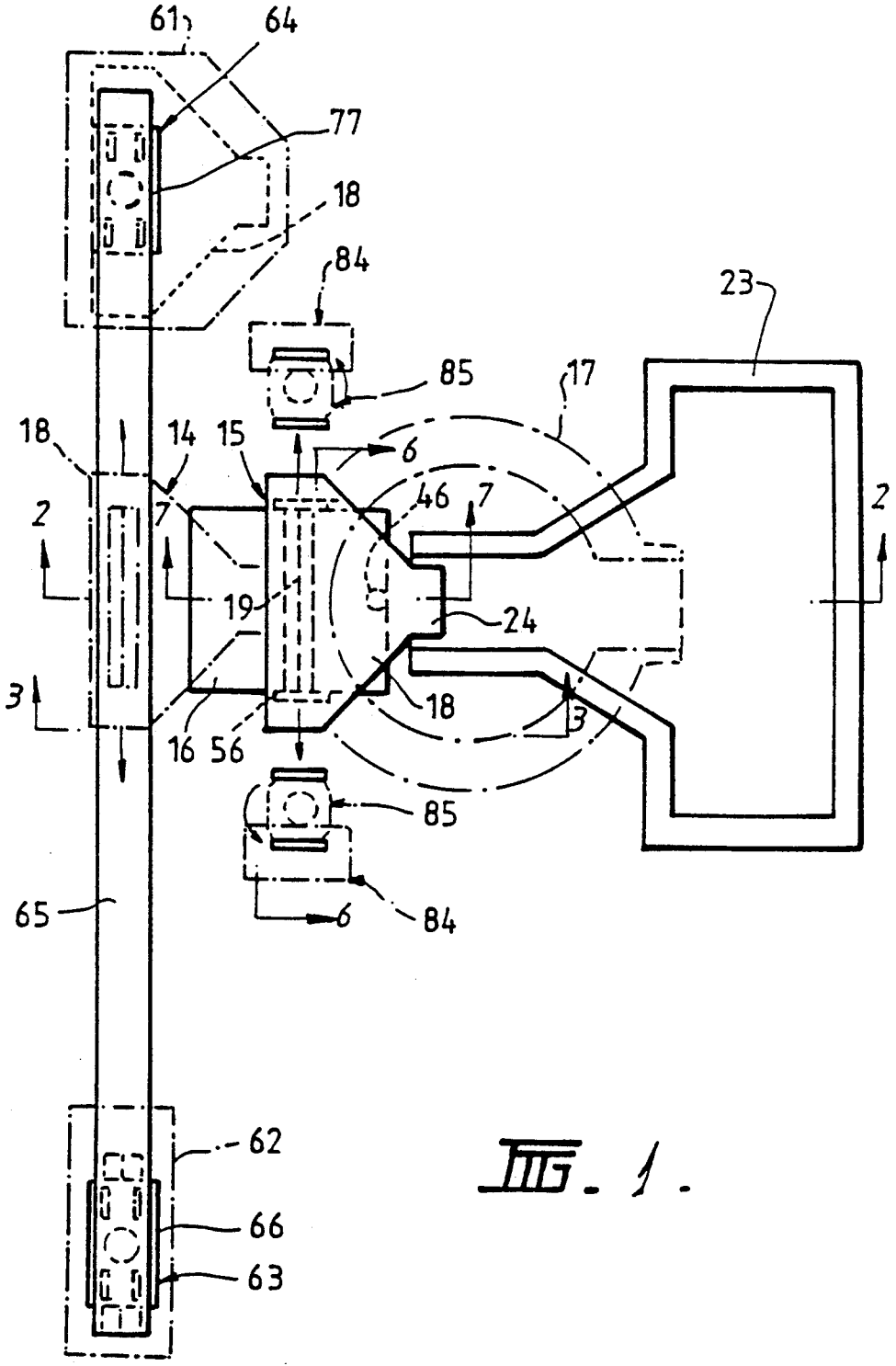
FIG. 1 is plan view of a continuous strip caster constructed in accordance with the invention and including a casting roller carriage movable between an assembly station and a casting station.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles 34 in which the rollers 16 are rotatably mounted. Roller cradles 34 are mounted on the carriage frame 31 by interengaging complementary slide members 35, 36 to allow the cradles to be moved on the carriage under the influence of hydraulic cylinder units 37, 38 to adjust the nip between the casting rollers 16. The carriage is movable as a whole along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to product 1300 mm wide strip product.

Figure 2:
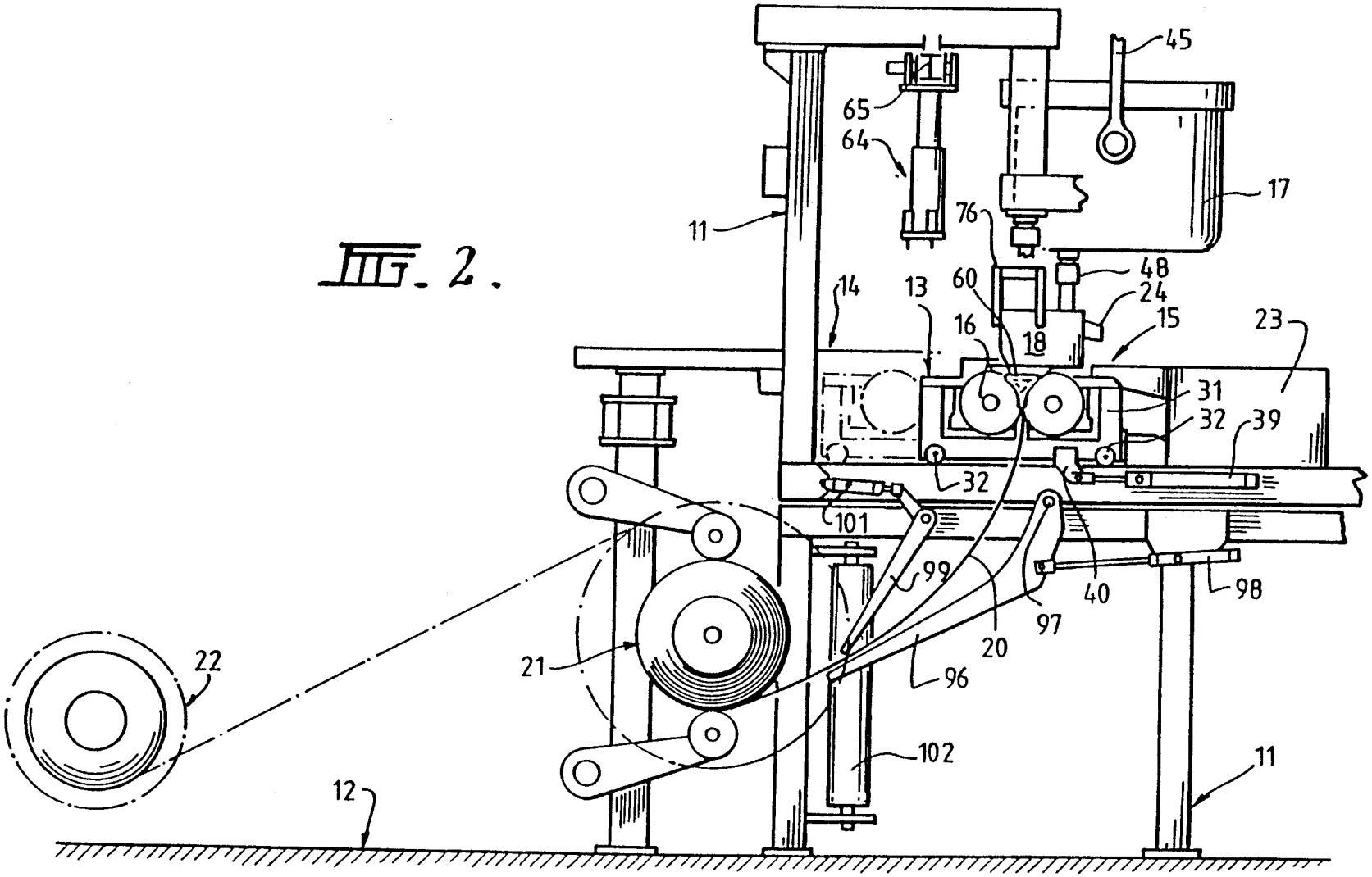
FIG. 2 is a vertical cross-section on the line 2—2 in FIG. 1.
Figure 7:
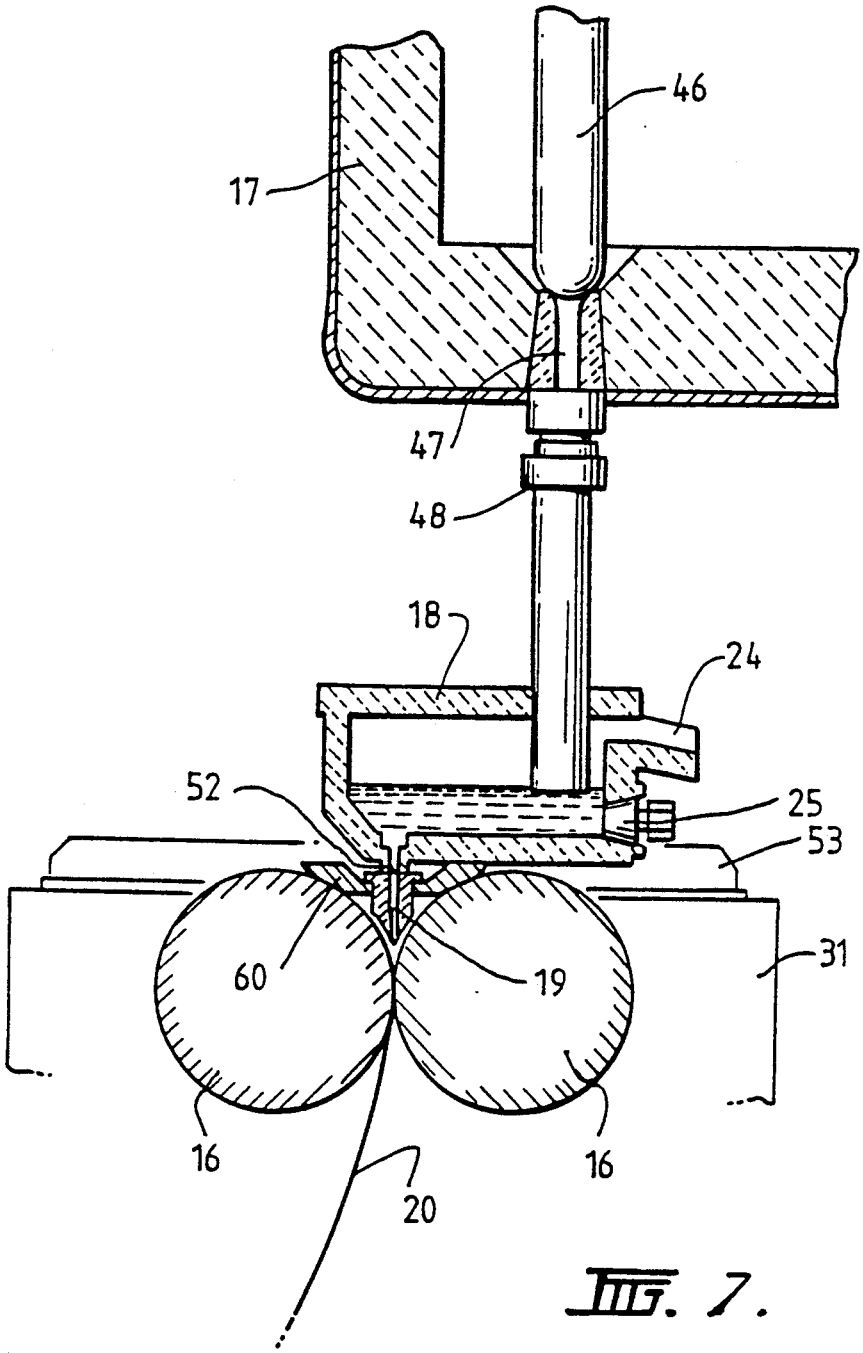
FIG. 7 is a vertical cross-section on the line 7—7 in FIG. 1.

The arrangement of the ladle, tundish and delivery nozzle during a casting operation is most clearly seen in FIGS. 1, 2 and 7. Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as alumina graphite. One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as accurately to locate the tundish as will be more fully described below.

Delivery nozzle 19 is formed as an elongate body made of a refractory material such as alumina graphite Its lower part is tapered so as to converge inwardly and downwardly so that it can project into the nip between casting rollers 16. It is provided with a mounting bracket 60 whereby to support it on the roller carriage frame and its upper part is formed with outwardly projecting and downwardly facing side shoulders 55 whereby it can be picked up and transported by a robot mechanism as described below.

Nozzle 19 may have a series of horizontally spaced generally vertically extending flow passages to produce a suitably low velocity discharge of metal throughout the width of the rollers and to deliver the molten metal into the nip between the rollers without direct impingement on the roller surfaces at which initial solidification occurs. Alternatively, the nozzle may have a single continuous slot outlet to deliver a low velocity curtain of molten metal directly into the nip between the rollers. The nozzle outlet may be above the meniscus level of the molten metal pool which forms above the nip between the rollers or it may be immersed in the molten metal pool. As will be more fully explained below, the pool is confined at the ends of the rollers by a pair of side closure plates 56 which are held against stepped ends 57 of the rollers when the roller carriage is at the casting station.

Prior to a casting operation ladle 17, tundish 18, metal delivery nozzle 19 and the side closure plates 56 must all be preheated to working temperature generally between 1200° C. and 1300° C. We have determined that it is possible to successfully cast ferrous metals to produce a satisfactory strip product if these preheated components are brought together into their operative positions relative to the casting rollers and casting is commenced within such a short time interval that the preheated components, and particularly the delivery nozzle, do not develop significant localized cool spots which can lead to uneven solidification during casting. To this end, the illustrated caster has provisions whereby the preheated tundish and distribution nozzle can be rapidly fitted to the casting roller carriage when the carriage is at the assembly station 14, the carriage can then be moved with the preheated tundish and delivery nozzle to the casting station where the preheated side plates can be rapidly applied to the ends of the casting rollers immediately prior to pouring of molten metal from ladle 17.

Tundish 18 is preheated in a gas furnace 61 located adjacent the assembly station 14 and delivery nozzle 19 is preheated in a nozzle preheat furnace 62 also located adjacent assembly station 14. After preheating computer controlled robot devices denoted generally as 63, 64 mounted on an overhead rail 65 on machine frame 11 are operative firstly to move the preheated delivery nozzle from the preheat furnace and to mount it on the roller carriage and then to similarly move the tundish onto the roller carriage so as to be disposed accurately above the distribution nozzle.

Figure 3:
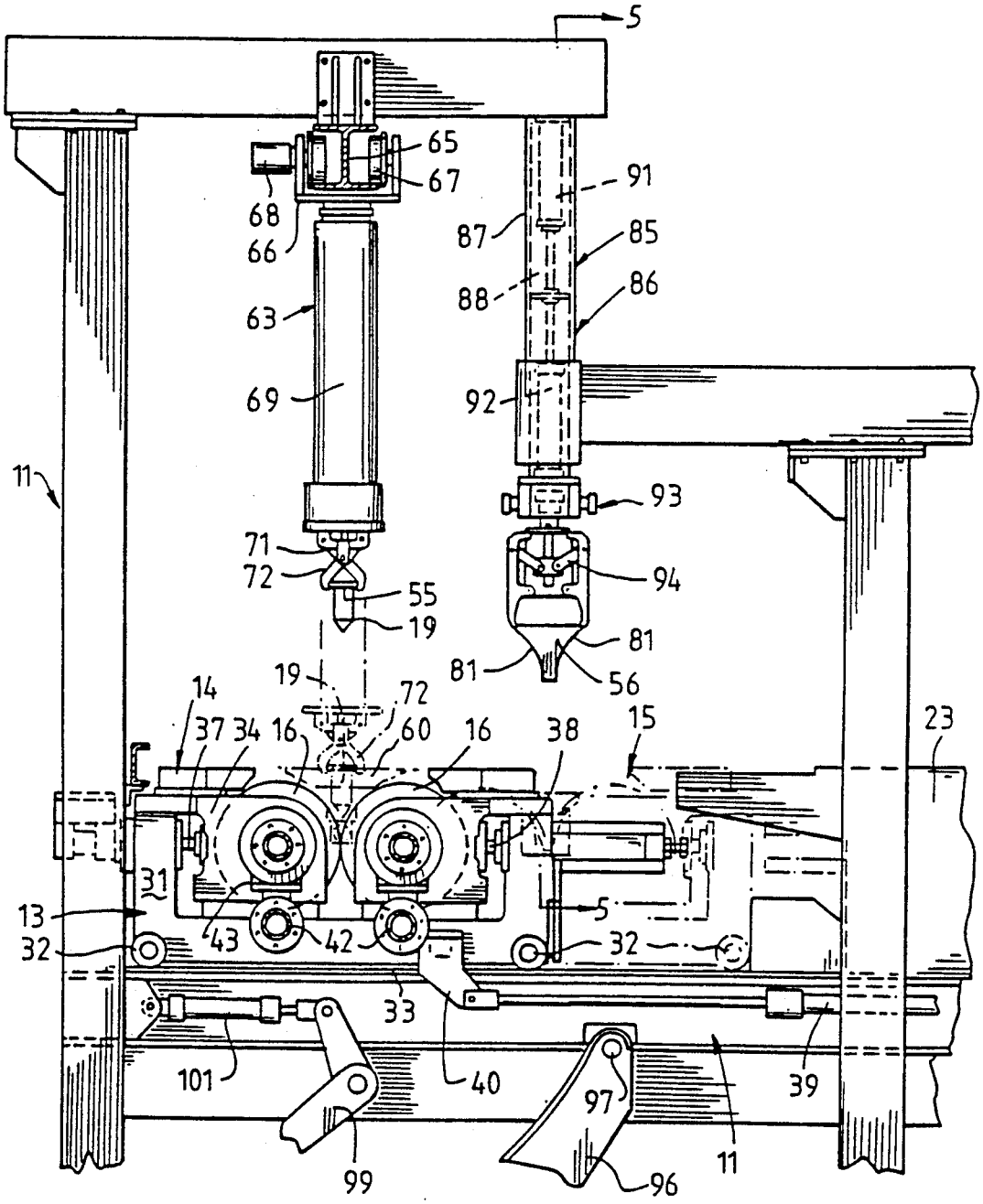
FIG. 3 is a vertical cross-section on the line 3—3 in FIG. 1.

The construction of robot device 63 and its operation to move the distribution nozzle 19 into position between the casting rollers is most clearly illustrated by FIGS. 1 and 3. As seen in those figures, overhead rail 65 extends transversely of the direction of movement of roller carriage 31 and it extends directly across the roller carriage above the nip between the rollers when the roller carriage is at assembly station 14. Device 63 comprises a carriage 66 mounted on rail 65 by wheels 67 and movable along the rail by operation of a drive motor 68 under computer control. Carriage 66 carries a downwardly depending pneumatic piston and cylinder unit 69 the lower end of which is fitted with a scissors mechanism 71 comprising inturned fingers 72 adapted to engage with the shoulders 55 at the upper end of the delivery nozzle 19.

Initially, device 63 is located above the delivery nozzle preheat furnace 62. After preheating cylinder unit 69 is extended to lower the scissors mechanism 71 which is actuated to engage the shoulders at the upper end of the delivery nozzle. Cylinder unit 69 is then retracted to lift the delivery nozzle out of the preheat furnace and carriage 66 is driven along overhead rail 65 to bring the delivery nozzle into a position disposed directly above the nip between the rollers 16 at the assembly station. Cylinder unit 69 is then actuated to lower the delivery nozzle into a position in which it seats in a mounting bracket 60 on the roller carriage frame 31 whereby it is supported in a position in which it projects downwardly into the nip between the casting rollers. The scissors mechanism 71 then releases and the cylinder unit 69 is retracted to lift it clear of the roller carriage. The whole device 63 is then moved away from the assembly station along overhead rail 65.

The construction of robot mechanism 64 and the manner in which it moves the tundish is most clearly illustrated in FIGS. 1 and 4. Device 64 comprises a carriage 77 mounted on overhead rail 65 by rollers 78 and movable along it by operation of a computer controlled drive motor 73. Carriage 77 carries a downwardly depending pneumatic piston and cylinder unit 74 the bottom of which is fitted with attachment devices 75 actuable releasably to attach to a lifting frame 76 fitted to the tundish.

Initially robot device 64 is located above the tundish as the tundish is being preheated in furnace 61 adjacent the assembly station 14. After preheating, cylinder unit 74 is extended and devices 75 actuated to engage with the tundish lifting frame 76. The cylinder unit 74 is then retracted to lift the tundish and carriage 77 is moved along rail 65 to bring the tundish into position above the roller carriage to which the preheated delivery nozzle has already been fitted. Cylinder unit 74 is then extended to lower the preheated tundish onto the roller carriage frame. The mounting brackets 53 at the bottom of the tundish support the tundish on the roller carriage frame and receive the indexing pegs 54 on the roller frame so as accurately to locate the tundish over the delivery nozzle. Devices 75 are then actuated to release the tundish frame and cylinder 74 is retracted to clear the carriage and tundish for movement from the assembly position to the casting position as indicated in FIG. 2.

Side closure plates 56 are made of a strong refractory material, for example boron nitride, and have scalloped side edges 81 to match the curvature of the stepped ends 57 of the rollers. The side plates can be mounted in plate holders 82 which are movable at the casting station by actuation of a pair of hydraulic cylinder units 83 to bring the side plates into engagement with the stepped ends of the casting rollers to form end closures for the molten pool of metal formed on the casting rollers during a casting operation.

Figure 5:
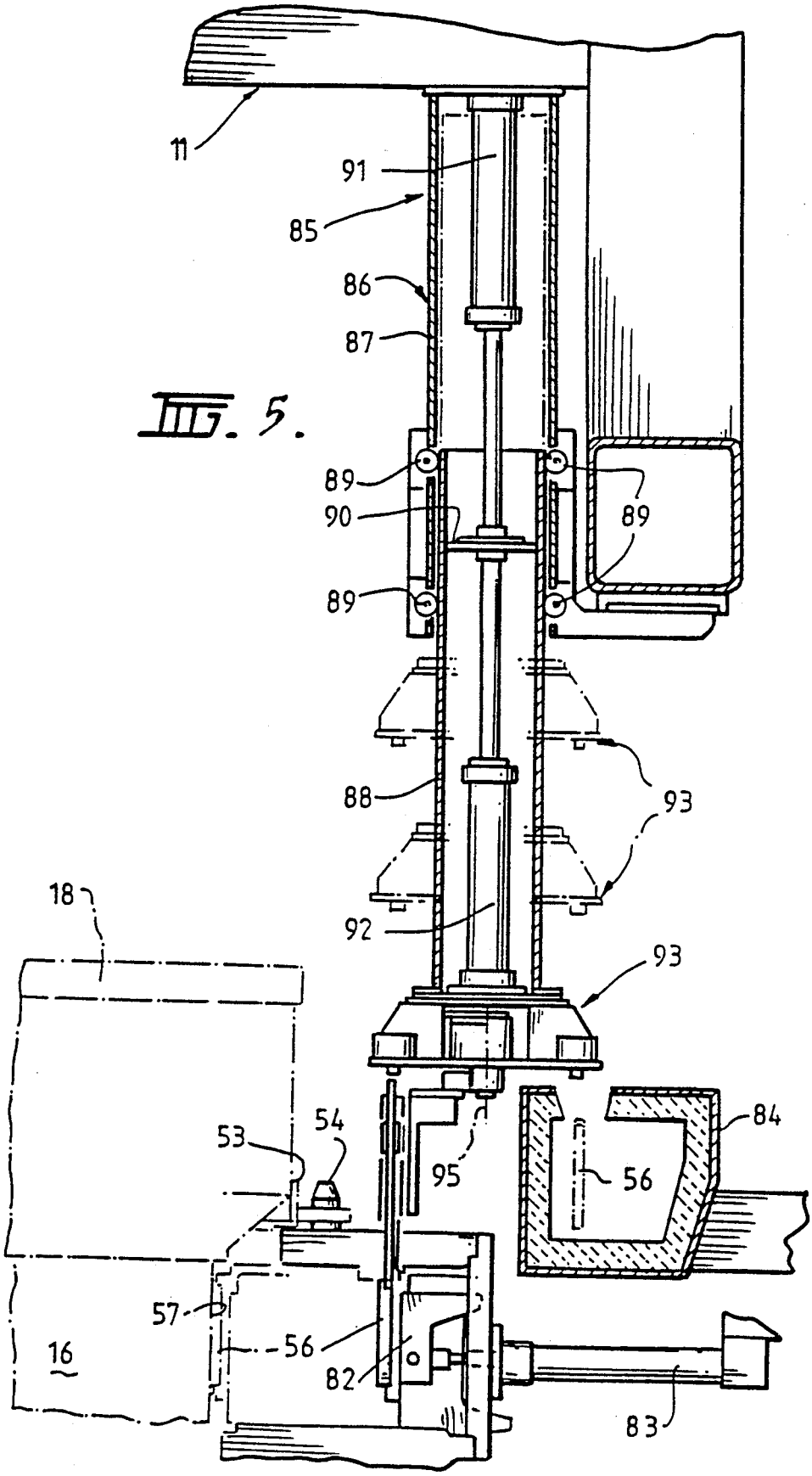
FIG. 5 is a vertical cross-section on the line 5—5 in FIG. 3 which particularly illustrates side plate positioning apparatus incorporated in the caster.
Figure 6:
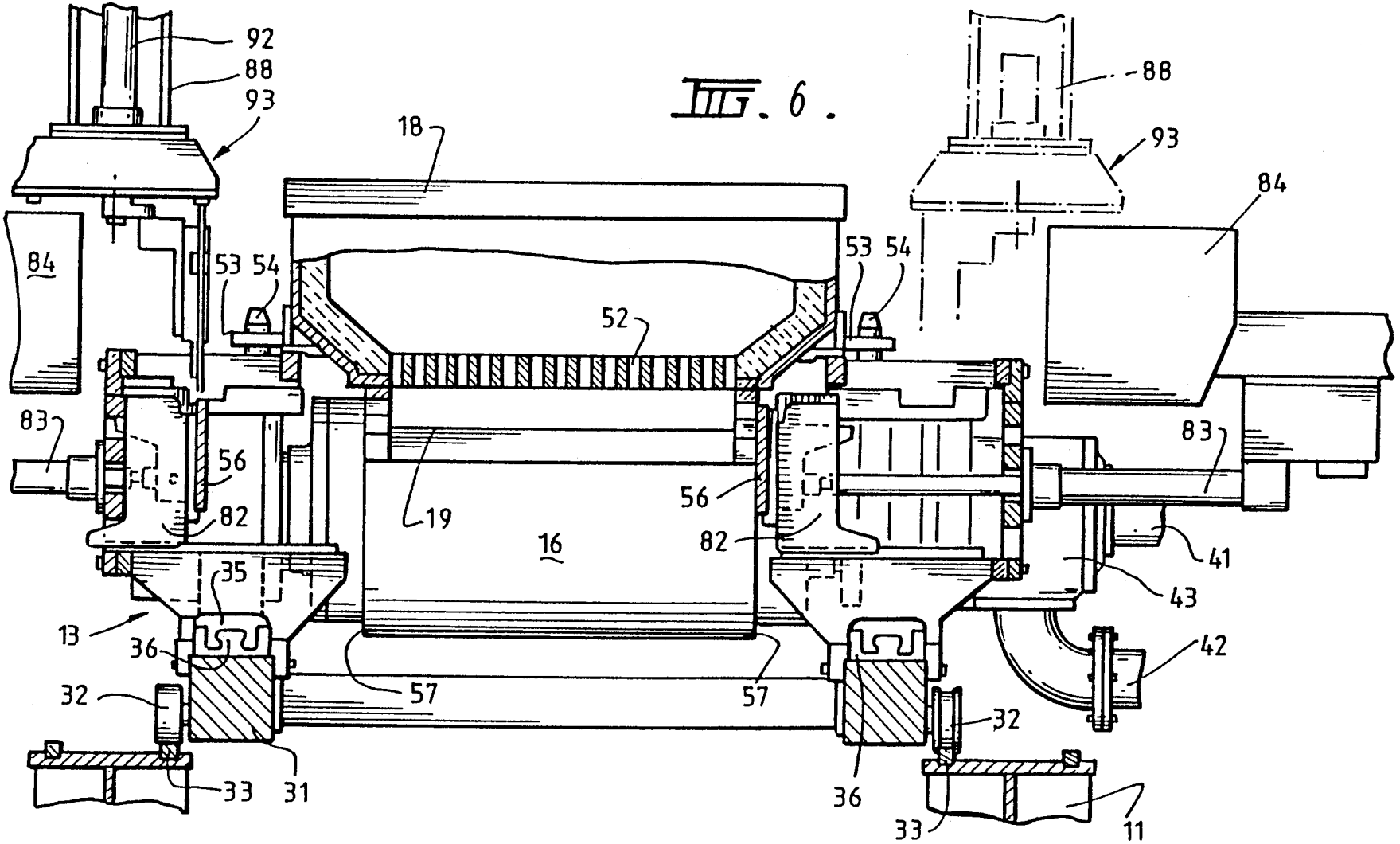
FIG. 6 is a vertical cross-section on the line 6—6 in FIG. 1.

Prior to the casting operation the side plates 56 are preheated in a pair of electric resistance heater furnaces 84 disposed one to each side of the casting station. After the preheating stage they are transferred from the furnaces 84 into the holders 86 by the operation of a pair of further robot devices denoted generally as 85. The construction of robot devices 85 and their operation to transfer the preheated side plates 56 from furnaces 84 into the side plate holders 82 is most clearly seen in FIGS. 1 and 5. Each device 85 comprises a vertical telescopic tubular structure 86 formed by an outer tube 87 fixed to machine frame 11 and an inner tube 88 which runs within the outer tube on rollers 89 and which can be raised and lowered by the operation of an internal double-acting extender formed by two pneumatic piston and cylinder units 91, 92, the pistons of which are joined and supported by a central slide 90.

The lower end of telescopic tube 88 carries a rotary head 93 which carries a pneumatically actuable clamp mechanism 94 and which is rotatable by operation of a pneumatic motor through 180° about a central vertical axis of rotation 95.

Devices 85 are disposed generally above and adjacent the two side plate preheat furnaces 84 and when the side plate holder actuator units 83 are in their retracted positions the side plate holders 82 are brought into positions below and adjacent furnaces 84. After the side plates have been preheated the telescopic tubular devices 86 are extended with the rotary heads 93 angularly positioned such that the clamping devices 94 can extend down into the furnaces 84 and can then be actuated to grip the preheated side plates. The telescopic devices 86 are then retracted to lift the side plates clear of the furnaces and the rotary heads 93 are rotated through 180° to move the side plates into positions directly above the side plate holders 82. The telescopic tubular devices 86 are then extended to lower the preheated side plates into the holders 82. The clamps 94 are then released and the telescopic devices 86 are fully retracted to lift devices 85 clear of the roller carriage. The side plate cylinder units 83 are then actuated to bring the preheated side plates into engagement with the stepped ends of the casting rollers. The side plates are biased against the rotating casting rollers by hydraulic cylinder units 83 throughout the casting operation.

Prior to a casting operation, the tundish and delivery nozzle are brought to a temperature of about 1200° to 1300° C. in the respective preheating facilities 61, 62 adjacent assembly station 14, the side plates are brought to a temperature of about 1250° C. in the side plate preheating furnaces 84 adjacent the casting station 15, the roller carriage is positioned at assembly station 14 and a hot ladle of steel is brought from the hot metal receiving station to the casting station. The following start up sequence of operations is then carried out:

1. The preheated delivery nozzle 19 is picked up by the appropriate robot device 63 and transported to the roller carriage and mounted on the roller carriage frame.

2. The preheated tundish 18 is picked up by the respective robot device 64 and put onto the roller carriage on which it is accurately positioned by the interengagement of the indexing pins 54 and the holes in the tundish mounting brackets.

3. The assembly of the roller carriage distribution nozzle and tundish is then moved along rails 34 to the casting station 15 by the operation of the hydraulic cylinder unit 39.

4. The preheated side plates 56 are lifted from preheat furnaces 84 by the robot device 85 and placed in side plate holders 82 and hydraulic cylinder units 83 are then actuated to bring the preheated side plates into engagement with the stepped ends 57 of the casting rollers.

5. The ladle stopper rod is actuated to allow molten metal to pour from the ladle to the tundish through the metal delivery nozzle whence it flows to the casting rollers.

6. The head end produced on initial pouring is guided by actuation of an apron table 96 to the jaws of coiler 21. Apron table 96 hangs from pivot mountings 97 on the main frame and can be swung toward the coiler by actuation of an hydraulic cylinder unit 98. Table 96 may operate against an upper strip guide flap 99 actuated by a piston and cylinder unit 101 and the strip may be confined between a pair of vertical side rollers 102. After the head end has been guided in to the jaws of the coiler, the coiler is rotated to coil the product and the apron table is allowed to swing back to its inoperative position where it simply hangs from the machine frame clear of the product which is taken directly onto coiler 21. The resulting strip product may be subsequently transferred to coiler 22 to produce a final coil for transport away from the caster.

The illustrated apparatus enables the start up operations to be completed comfortably within about one and a half minutes which has allowed successful casting of ferrous metal strip product. However, this particular apparatus is advanced by way of example only and it could be modified considerably. The general layout could be modified as could the specific design of the various individual components in the apparatus. It is accordingly to be understood that the invention is in no way limited to details of the illustrated apparatus and that many variations will fall within the scope of the appended claims.

We claim:

1. Apparatus for casting metal strip comprising: roller carriage means movable between first and second stations adapted to support a casting assembly thereon;

a pair of generally horizontal, substantially parallel casting rollers forming a nip between them;

a metal delivery nozzle means operatively associated with said casting rollers for delivery of molten metal into said nip between said casting rollers;

a tundish means operatively associated with said metal delivery nozzle means and said casting rollers, for supply of molten metal to said delivery nozzle, which casting rollers, metal delivery nozzle and tundish collectively formed metal casting assembly;

means to mount said casting assembly on said roller carriage means;

preheat means for preheating said delivery nozzle and said tundish;

transfer means for transferring the preheated delivery nozzle and tundish from the preheating means into operative association with said casting rollers mounted on said roller carriage at said first station;

carriage drive means for driving the roller carriage and with it said mounted casting assembly from the first station to the second station;

a pair of demountable side closure plates adapted to engage the casting rollers one at each end of the nip, to form side closures of a reservoir of molten metal to be formed above the nip in use of the apparatus;

side closure plate preheating means for preheating the side closure plates at positions remote from the roller and adjacent the second station;

side plate applicator means operable to move the preheated side plates into operative engagement with the casting rollers when the roller carriage and said casting assembly are at said second station; and metal pouring means operable at said second station for pouring molten metal into said tundish thence into said metal delivery nozzle and thence into said nip.

2. Apparatus as claimed in claim 1, wherein the side plate preheating means comprise a pair of side plate preheaters disposed to opposite sides of the roller carriage.

3. Apparatus as claimed in claim 1, wherein the side plate applicator means comprises a pair of pressure fluid cylinder units operative to bias the side plates against the casting rollers under pressure of fluid in said cylinder units.

4. Apparatus as claimed in claim 1, wherein the carriage drive means comprises a pressure fluid cylinder unit connected to the roller carriage and extensible and retractable to move the roller carriage between the first and second stations.

5. Apparatus as claimed in claim 1, wherein the roller carriage is mounted on rails for movement between the first and second stations.

6. Apparatus as claimed in claim 1, wherein the roller carriage carries drive means operable to contra-rotate the casting rollers.

7. Apparatus as claimed in claim 1, wherein the roller carriage has nozzle and tundish supports to interengage with the nozzle and the tundish so as positively to position the nozzle to deliver metal into the nip between the rollers and positively to position the tundish on the carriage above the nozzle.

8. Apparatus as claimed in claim 1, including means to transfer the preheated delivery nozzle and tundish from the preheat means to an operative position proximate to said roller carriage and to start pouring metal at most three minutes after cessation of said preheating.

9. Apparatus claimed in claim 1 including means to preheat to a temperature of about 1200° to 1300° C.

10. Apparatus as claimed in claim 1 wherein said preheat means are remote from said casting roller assembly.

11. Apparatus as claimed in claim 1 including separate preheating means for said metal delivery nozzle and said tundish.

12. Apparatus as claimed in claim 1 wherein said side plate preheating means is proximate to said second station.

13. Apparatus as claimed in claim 2 wherein said side plate preheaters are disposed to opposite sides of said second roller carriage station.

14. Apparatus as claimed in claim 1 including means to chill cool said casting rollers.

15. Apparatus as claimed in claim 1 wherein said metal is steel and means to preheat said metal delivery nozzle and said tundish to at least about 1,000° C. before moving such into operative association with said casting rollers.

* * * * *